US006267132B1

(12) United States Patent
Guarneri

(10) Patent No.: US 6,267,132 B1
(45) Date of Patent: Jul. 31, 2001

(54) LIQUID DELIVERY SYSTEM AND ITS USE FOR THE DELIVERY OF AN ULTRAPURE LIQUID

(75) Inventor: Georges Guarneri, Le Pont de Claix (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/497,166

(22) Filed: Feb. 3, 2000

(30) Foreign Application Priority Data

Feb. 26, 1999 (FR) ..... 99 02467

(51) Int. Cl.[7] ..... F04F 1/10
(52) U.S. Cl. ..... 137/14; 137/208; 137/209
(58) Field of Search ..... 137/208, 209, 137/14

(56) References Cited

U.S. PATENT DOCUMENTS 5,148,945 * 9/1992 Geatz ..... 137/208 X
5,330,072 7/1994 Ferri, Jr. et al. .
5,417,346 5/1995 Ferri, Jr. et al. .
5,556,002 9/1996 Green .
5,772,447 7/1998 Cheung .
5,832,948 11/1998 Schell .

FOREIGN PATENT DOCUMENTS

WO 92/05406 4/1992 (WO) .

* cited by examiner

*Primary Examiner*—Gerald A. Michalsky
(74) *Attorney, Agent, or Firm*—Burns, Doane, Swecker & Mathis, L.L.P.

(57) ABSTRACT

The liquid to be delivered leaves a container (3A, 3B) maintained at a first overpressure P1, from where it is transferred to an intermediate storage tank (11) maintained at a predetermined intermediate pressure P2>P1. Several small-volume delivery containers (12A, 12B), each of which may be pressurized either to a delivery pressure P3>P2 or to a filling pressure P4<P2, are connected in parallel downstream of this tank. The invention has applicability to the delivery of ultrapure chemicals intended for the microelectronics industry.

31 Claims, 1 Drawing Sheet

LIQUID DELIVERY SYSTEM AND ITS USE FOR THE DELIVERY OF AN ULTRAPURE LIQUID

This application claims priority under 35 U.S.C. §§119 and/or 365 to 99 02467 filed in France on Feb. 26, 1999; the entire content of which is hereby incorporated by reference.

BACKGROUND OF THE INVENTION

1. Field of the Invention

The present invention relates to a liquid delivery system. It applies in particular to the delivery of ultrapure chemicals, especially those intended for the microelectronics industry.

The pressures involved here are relative pressures.

2. Description of the Related Art

The rapid development in the microelectronics industry towards ever greater miniaturization has consequences with regard to the purity of the chemicals used in various phases of the fabrication of integrated circuits. It is now becoming common practice, in the case of chemicals such as hydrogen peroxide, aqueous ammonia and hydrofluoric acid, to specify cation contents of less than 1 ppb (part per billion) and particle contents of less than 500 particles of 0.2 micrometer in size per liter.

These so-called ultrapure liquid chemicals used, for example, in cleaning processes are delivered over and above a certain consumption by centralized delivery systems. These systems comprise the following functions:

- withdrawal of the product from a supplier product source, or supply container, to a storage tank, through filtration stages for improving the particulate specifications of the product, possibly with recirculation through the filtration stages in order to improve the particulate specifications of the product while still maintaining the ionic quality;
- delivery of the product from the storage tank to a user network via a filtration stage in order to improve the particulate specifications of the product.

Various means are known for conveying the product from the storage tank. These means use either pumps, or pressure, or vacuum, or else combinations of these means (see, for example, U.S. Pat. Nos. 5,330,072, 5,417,346 and 5,722,447).

These means have certain drawbacks:

Pumped delivery generates particles associated with the pressure variations of the pumps, and the pumps pose reliability problems.

Pressure and vacuum delivery poses reliability problems associated with the incompatibility towards diaphragm valves in a vacuum system, while these diaphragm valves are the only ones compatible with the required purity levels.

Conventional pressure delivery systems use at least two storage tanks of large individual volume, typically corresponding to the daily consumption of the equipment. Typically, the minimum volume of the tanks is 200 l. This requires large cabinet dimensions and the tanks must be able to withstand the delivery pressure, of about 4 bar, or a vacuum. To do this, in the case of corrosive products, the materials used comprise an inner shell made of plastic of the polyethylene (PE), perfluoroalkoxy (PFA) or polyvinylidene fluoride (PVDF) type and an outer reinforcement made of glass fibre or of stainless steel. This tank design can result in ionic contaminations, if the fabrication processes are not perfectly controlled, and safety problems associated with pressurization or with a vacuum in the case of large-volume tanks.

SUMMARY OF THE INVENTION

The object of the invention is to provide a compact delivery system which is relatively easy to manufacture, minimizes the risk of contaminating the liquid and optimizes safety.

For this purpose, the subject of the invention is a liquid delivery system which comprises:

- a supply container containing a liquid to be delivered, provided with means for maintaining an overhead at an overpressure of less than a first predetermined pressure P1;
- an intermediate storage tank provided with means for maintaining an overhead at a predetermined intermediate pressure P2>P1;
- means for transferring the liquid from the supply container to the intermediate tank;
- at least two delivery containers having a very much smaller volume than that of the intermediate tank, these containers being connected, in parallel, upstream of a liquid outlet in the latter and downstream of a line for delivering the liquid to a user network; and
- control means for applying individually to each container either a delivery pressure P3>P2 or a filling pressure P4<P2.

The delivery system according to the invention may include one or more of the following characteristics, taken in isolation or in any of their technically possible combinations:

- the system comprises three delivery containers connected in parallel;
- the transfer means and/or the delivery line are equipped with means for filtering the liquid;
- the said maintaining means and the said control means comprise sources of inerting gas, especially nitrogen, these sources being equipped with pressure-regulating means;
- the delivery system comprises a line for recycling liquid from the delivery line to the inlet of the storage tank;
- the delivery system comprises a line for recycling liquid from the user network to the inlet of the storage tank;
- each delivery container consists of a section of vertical pipe closed off at its lower end by a supply and discharge tee and at its upper end by a stopper equipped with an inlet for pressurizing gas;
- the pressure P1 is approximately equal to 100 mb and/or the pressure P2 is between approximately 100 and 500 mb and/or the pressure P3 is between approximately 500 mb and 6 bar; and
- the volumes of the storage tank and of each delivery container are between 200 l and 5 $m^3$ and between 1 and 50 l, respectively.

The subject of the invention is also the use of such a delivery system for the delivery of an ultrapure liquid, especially hydrogen peroxide, aqueous ammonia or hydrofluoric acid.

BRIEF DESCRIPTION OF THE FIGURES OF THE DRAWING

An illustrative example will now be described with regard to the appended drawings in which.

Figure 1:
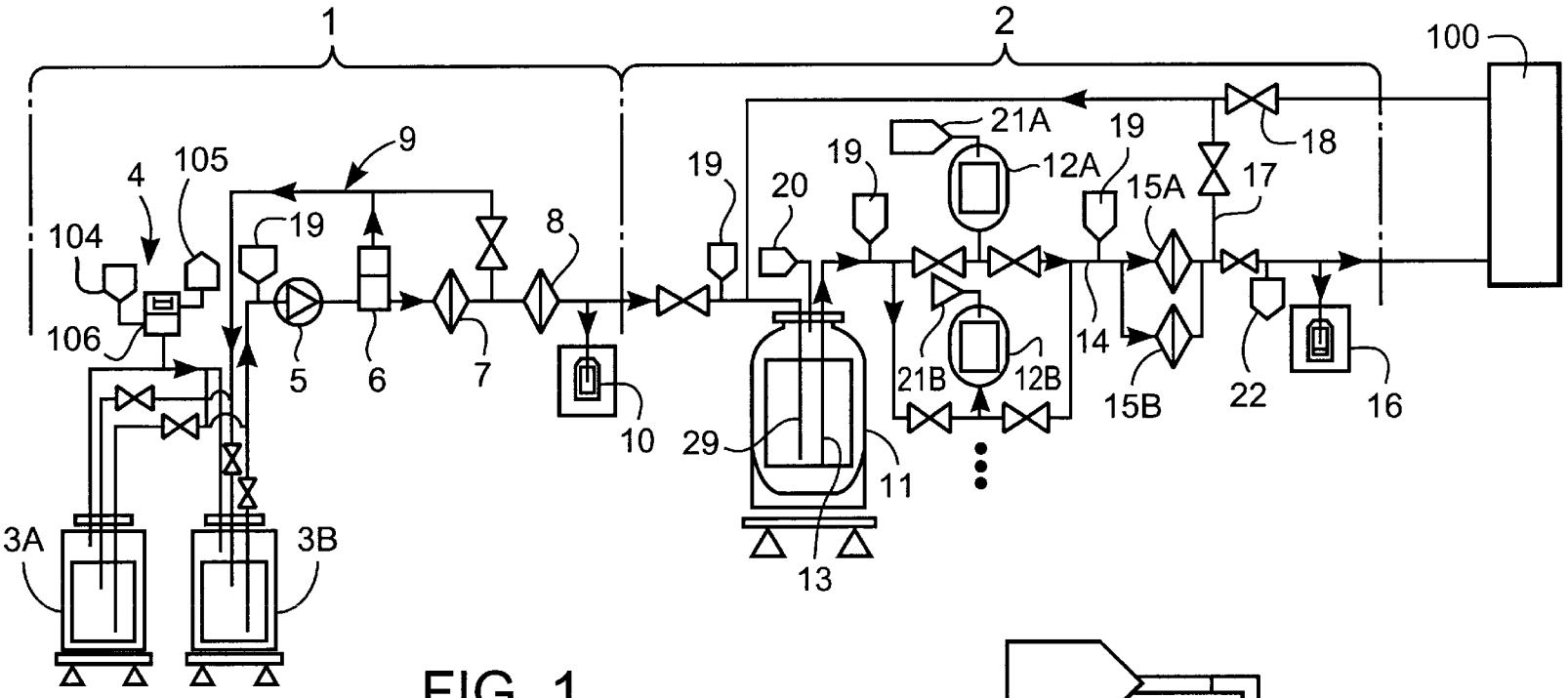
- FIG. 1 shows schematically an ultrapure liquid delivery system according to the invention.

The delivery system shown in FIG. 1 is intended to deliver an ultrapure liquid to a user network 100. The system consists of an upstream supply part 1 and a downstream delivery part 2.

The upstream part comprises, from the upstream end to the downstream end:

- two supply containers or drums 3A, 3B which are placed in parallel and used in succession. Each of these drums contains the liquid to be delivered, but not having the very low desired particle content;
- a device 4 for maintaining a slight gaseous overpressure, of less than a predetermined pressure P1, in the two drums. The pressure P1 is typically between 50 and 100 mb. The device 4 comprises a nitrogen supply 104, a vent 105 and a regulator 106 suitable for connecting the overhead in the drums 3A and 3B either to the source 104 or to the vent 105. Devices of this type are commercially available;
- a circulation pump 5;
- a degassing device 6 designed to protect the filters located downstream from drying out;
- a first filter 7;
- a second filter 8;
- between the two filters 7 and 8, a tap-off line 9, equipped with a valve, for recycling liquid into the drums 3A and 3B.

The figure also shows, downstream of the filter 8, a sampling can 10 used for analyzing the conveyed liquid.

The delivery part 2 consists, from the upstream end to the downstream end:

- a storage tank 11;
- two delivery containers 12A, 12B connected in parallel. These containers are connected, on the upstream side, to a dip pipe 13 for removing liquid from the tank 11 and, on the downstream side, to a line 14 for delivering the liquid.

The line 14 is equipped with two filters 15A, 15B, which are connected in parallel, and then with a sampling and analysis can 16, and it terminates in the user network 100.

A line 17 tapped off from the line 14 downstream of the filters 15A, 15B allows liquid to be recycled into the inlet of the tank 11, and another line 18 allows excess liquid to be recycled from the user network 100 into the same place.

FIG. 1 also shows various accessories:

- several sources 19 of deionized water, used for rinsing the system;
- a source 20 for the regulated supply of nitrogen to the overhead in the tank 11 and sources 21A and 21B for the regulated supply of nitrogen to the containers 12A and 12B, respectively;
- a particle counter 22 branched off the line 14 downstream of the tap-off 17; and
- a number of valves which make it possible to carry out the operation, which will be described below.

Of course, the plant also includes a number of measurement and control members, which are known per se and have not been shown in order not to clutter up the drawing.

By way of example, the drums 3A and 3B may have a volume of 100 to 20,000 liters, the tank 11, made of slightly fibre-reinforced PE, PFA or PVDF, may have a volume of 200 l to 5 $m^3$ and the containers 12A and 12B may have a volume very much smaller than the previous one, typically from 1 to 50 liters.

The filter 7 is a diaphragm microfiltration member, filtering down to 0.2 $\mu$m, the filter 8 filters down to 0.1 $\mu$m and the filters 15A and 15B filter down to 0.05 $\mu$m.

Figure 2:
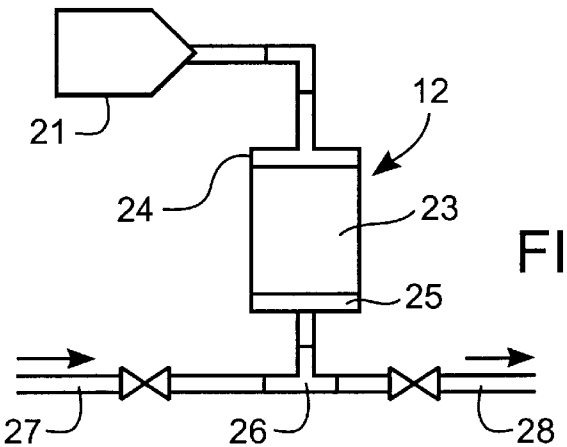
- FIG. 2 shows an advantageous embodiment of part of the system in FIG. 1.

In one particularly advantageous embodiment illustrated in FIG. 2, each container 12A, 12B consists of a section of pipe 23 made of unreinforced PE, PFA or PVDF, the thickness of which is designed to withstand the delivery pressure. This pipe is placed vertically, its upper end is closed off by a stopper 24 connected to the associated nitrogen source 21A or 21B and its lower end is closed off by a second stopper 25 to which a connection tee 26 is connected. The two horizontal branches of this tee are connected, on the upstream side, to a line 27 which is itself connected to the dip pipe 13 and, on the downstream side, to a line 28 which is itself connected to the line 14, respectively.

Such an embodiment is inexpensive and very reliable, and the same applies to the tank 11 which only has to withstand the pressure P2 which is less than 500 mb.

In addition, the overall size of the delivery part 2 is particularly small.

In operation, the overhead in the drums 3A and 3B is maintained at a slight overpressure, at a pressure of less than 100 mb, by the device 4. The liquid pumped by the pump 5 passes through the filters 7 and 8 and some of the liquid is possibly recycled via the line 9. The uncycled liquid enters the storage tank 11 via a second dip pipe 29, which supplies it with source liquid.

The overhead in this tank is constantly maintained at a predetermined pressure P2, of less than 500 mb, by the source 20.

One of the two containers 12A, 12B, for example the container 12B, is maintained at a pressure P4, which is positive or zero but less than the pressure P2, by its nitrogen source 21B, and its outlet valve is closed whereas its inlet valve is open. The other container 12A has its inlet valve closed and its outlet valve open, and it is maintained at a pressure P3 which is greater than P2 and equal to the pressure of delivery by its nitrogen source 21A.

Thus, the container 12B fills up while the container 12A is being used for delivery. When the level of the liquid in the container 12A has fallen below a predetermined threshold, the pressures in the two containers are reversed, as is the state of their inlet and outlet valves, so that the container 12A fills up while the container 12B empties into the delivery line 14.

The liquid thus continuously delivered undergoes the final filtration step at 15A and/or 15B and is then sent via the line 14 to the user network 100.

Optionally, ultrapure liquid may be recycled into the tank 11, from the line 14 via the tap-off 17 and/or from the network 100 via the line 18.

As a variant, a third delivery container, similar to the containers 12A and 12B, may be provided and connected in parallel with the latter, as a back-up container.

What is claimed is:

1. Liquid delivery system, comprising:

a supply container containing a liquid to be delivered, provided with means for maintaining an overhead at an overpressure of less than a first predetermined pressure P1;

an intermediate storage tank provided with means for maintaining an overhead at a predetermined intermediate pressure P2>P1;

means for transferring the liquid from the supply container to the intermediate tank;

at least two delivery containers having a smaller volume than that of the intermediate tank, these containers being connected, in parallel, downstream of a liquid outlet in the latter and upstream of a line for delivering the liquid to a user network; and control means for applying individually to each container either a delivery pressure P3>P2 or a filling pressure P4<P2.

2. Liquid delivery system according to claim 1, wherein said at least two delivery containers comprise three delivery containers connected in parallel.

3. Liquid delivery system according to claim 2, wherein one or both of the transfer means and the delivery line are equipped with means for filtering the liquid.

4. Liquid delivery system according to claim 2, wherein the maintaining means and the control means comprise sources of inerting gas equipped with pressure-regulating means.

5. Liquid delivery system according to claim 4, wherein the inerting gas is nitrogen.

6. Liquid delivery system according to claim 2, further comprising a line for recycling liquid from the delivery line into the inlet of the storage tank.

7. Liquid delivery system according to claim 2, further comprising a line for recycling liquid from the user network into the inlet of the storage tank.

8. Liquid delivery system according to claim 2, wherein each delivery container has a section of vertical pipe closed off at its lower end by a supply and discharge tee and at its upper end by a stopper equipped with an inlet for pressurizing gas.

9. Liquid delivery system according to claim 2, wherein one or more of the following conditions is present:

the pressure P1 is approximately equal to 100 mb;

the pressure P2 is between approximately 100 and 500 mb; and the pressure P3 is between approximately 500 mb and 6 bar.

10. Liquid delivery system according to claim 2, wherein the volumes of the storage tank and of each delivery container are between 200 l and 5 $m^3$ and between 1 and 50 l, respectively.

11. Liquid delivery system according to claim 1, wherein one or both of the transfer means and the delivery line are equipped with means for filtering the liquid.

12. Liquid delivery system according to claim 11, wherein the maintaining means and the control means comprise sources of inerting gas equipped with pressure-regulating means.

13. Liquid delivery system according to claim 12, wherein the inerting gas is nitrogen.

14. Liquid delivery system according to claim 11, further comprising a line for recycling liquid from the delivery line into the inlet of the storage tank.

15. Liquid delivery system according to claim 11, further comprising a line for recycling liquid from the user network into the inlet of the storage tank.

16. Liquid delivery system according to claim 11, wherein each delivery container has a section of vertical pipe closed off at its lower end by a supply and discharge tee and at its upper end by a stopper equipped with an inlet for pressurizing gas.

17. Liquid delivery system according to claim 11, wherein one or more of the following conditions is present:

the pressure P1 is approximately equal to 100 mb;

the pressure P2 is between approximately 100 and 500 mb; and the pressure P3 is between approximately 500 mb and 6 bar.

18. Liquid delivery system according to claim 11, wherein the volumes of the storage tank and of each delivery container are between 200 l and 5 $m^3$ and between 1 and 50 l, respectively.

19. Liquid delivery system according to claim 1, wherein the maintaining means and the control means comprise sources of inerting gas equipped with pressure-regulating means.

20. Liquid delivery system according to claim 19, wherein the inerting gas is nitrogen.

21. Liquid delivery system according to claim 1, further comprising a line for recycling liquid from the delivery line into the inlet of the storage tank.

22. Liquid delivery system according to claim 1, further comprising a line for recycling liquid from the user network into the inlet of the storage tank.

23. Liquid delivery system according to claim 1, wherein each delivery container has a section of vertical pipe closed off at its lower end by a supply and discharge tee and at its upper end by a stopper equipped with an inlet for pressurizing gas.

24. Liquid delivery system according to claim 1, wherein one or more of the following conditions is present:

the pressure P1 is approximately equal to 100 mb;

the pressure P2 is between approximately 100 and 500 mb; and the pressure P3 is between approximately 500 mb and 6 bar.

25. Liquid delivery system according to claim 1, wherein the volumes of the storage tank and of each delivery container are between 200 l and 5 $m^3$ and between 1 and 50 l, respectively.

26. A method of delivering an ultrapure liquid which comprises transporting the ultrapure liquid through a liquid delivery system from a storage tank to a user network, wherein the liquid delivery system comprises:

a supply container containing a liquid to be delivered, provided with means for maintaining an overhead at an overpressure of less than a first predetermined pressure P1;

an intermediate storage tank provided with means for maintaining an overhead at a predetermined intermediate pressure P2>P1;

means for transferring the liquid from the supply container to the intermediate tank;

at least two delivery containers having a smaller volume than that of the intermediate tank, these containers being connected, in parallel, downstream of a liquid outlet in the latter and upstream of a line for delivering the liquid to a user network; and control means for applying individually to each container either a delivery pressure P3>P2 or a filling pressure P4<P2.

27. The method of claim 26, wherein the ultrapure liquid is hydrogen peroxide, aqueous ammonia or hydrofluoric acid.

28. A method of delivering an ultrapure liquid which comprises transporting the ultrapure liquid through a liquid delivery system from a storage tank to a user network, wherein the liquid delivery system comprises:

a supply container containing a liquid to be delivered, provided with means for maintaining an overhead at an overpressure of less than a first predetermined pressure P1;

an intermediate storage tank provided with means for maintaining an overhead at a predetermined intermediate pressure P2>P1;

means for transferring the liquid from the supply container to the intermediate tank;

at least two delivery containers having a smaller volume than that of the intermediate tank, these containers being connected, in parallel, downstream of a liquid outlet in the latter and upstream of a line for delivering the liquid to a user network; and control means for applying individually to each container either a delivery pressure P3>P2 or a filling pressure P4<P2, wherein said at least two delivery containers comprise three delivery containers connected in parallel.

29. The method of claim 28, wherein the ultrapure liquid is hydrogen peroxide, aqueous ammonia or hydrofluoric acid.

30. A method of delivering an ultrapure liquid which comprises transporting the ultrapure liquid through a liquid delivery system from a storage tank to a user network, wherein the liquid delivery system comprises:

a supply container containing a liquid to be delivered, provided with means for maintaining an overhead at an overpressure of less than a first predetermined pressure P1;

an intermediate storage tank provided with means for maintaining an overhead at a predetermined intermediate pressure P2>P1;

means for transferring the liquid from the supply container to the intermediate tank;

at least two delivery containers having a smaller volume than that of the intermediate tank, these containers being connected, in parallel, downstream of a liquid outlet in the latter and upstream of a line for delivering the liquid to a user network; and control means for applying individually to each container either a delivery pressure P3>P2 or a filling pressure P4<P2, wherein one or both of the transfer means and the delivery line are equipped with means for filtering the liquid.

31. The method of claim 30, wherein the ultrapure liquid is hydrogen peroxide, aqueous ammonia or hydrofluoric acid.

* * * * *